US008960135B2

(12) United States Patent
Gibby et al.

(10) Patent No.: US 8,960,135 B2
(45) Date of Patent: Feb. 24, 2015

(54) EJECTOR COOLANT PUMP FOR INTERNAL COMBUSTION ENGINE

(75) Inventors: Dale G. Gibby, Columbus, IN (US); Mark N. Bays, Columbus, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 16 days.

(21) Appl. No.: 13/407,516

(22) Filed: Feb. 28, 2012

(65) Prior Publication Data

US 2012/0216760 A1 Aug. 30, 2012

Related U.S. Application Data

(60) Provisional application No. 61/447,538, filed on Feb. 28, 2011.

(51) Int. Cl.
*F01P 5/10* (2006.01)
*F01P 7/16* (2006.01)

(52) U.S. Cl.
CPC ..... *F01P 5/10* (2013.01); *F01P 2060/16* (2013.01); *F01P 2025/44* (2013.01); *F01P 7/164* (2013.01); *F01P 2005/105* (2013.01)
USPC ..... 123/41.45

(58) Field of Classification Search
CPC ..... F01P 5/00; F01P 5/10; F01P 5/12
USPC ..... 123/41.02, 41.31, 41.41, 41.45
See application file for complete search history.

(56) References Cited

U.S. PATENT DOCUMENTS

| | | | | |
|---|---|---|---|---|
| 1,812,899 | A * | 7/1931 | Pope, Jr. | 123/41.26 |
| 4,342,200 | A | 8/1982 | Lowi, Jr. | |
| 4,561,387 | A * | 12/1985 | Korkemeier et al. | 123/41.31 |
| 4,893,589 | A * | 1/1990 | Spinnler | 123/41.31 |
| 4,911,110 | A | 3/1990 | Isoda et al. | |
| 6,675,609 | B2 | 1/2004 | Takeuchi et al. | |
| 7,748,226 | B2 | 7/2010 | Iwanami et al. | |
| 2003/0070427 | A1 * | 4/2003 | Banzhaf et al. | 60/320 |
| 2006/0185626 | A1 * | 8/2006 | Allen et al. | 123/41.12 |
| 2008/0066697 | A1 | 3/2008 | Raab et al. | |
| 2009/0229543 | A1 | 9/2009 | Suzuki | |
| 2009/0277401 | A1 * | 11/2009 | Theorell | 123/41.1 |

OTHER PUBLICATIONS

The International Search Report and the Written Opinion of the International Searching Authority dated Jun. 6, 2012; International Application No. PCT/US2012/027001.

* cited by examiner

*Primary Examiner* — Lindsay Low
*Assistant Examiner* — Jacob Amick
(74) *Attorney, Agent, or Firm* — Faegre Baker Daniels LLP

(57) ABSTRACT

An internal combustion engine includes a cooling fluid circuit and a pumping circuit. The pumping circuit drives an ejector pump located along the cooling fluid circuit, enabling a reduced parasitic load on the engine from pumping cooling fluid through the cooling fluid circuit.

20 Claims, 1 Drawing Sheet

EJECTOR COOLANT PUMP FOR INTERNAL COMBUSTION ENGINE

CROSS-REFERENCE TO RELATED APPLICATIONS

This application claims the benefit of priority to U.S. Provisional Patent Application No. 61/447,538, filed on Feb. 28, 2011, which is hereby incorporated by reference in its entirety.

TECHNICAL FIELD

This disclosure relates to a system for pumping cooling fluid or coolant in an internal combustion engine using waste heat.

BACKGROUND

Cooling an internal combustion engine represents a parasitic load on the engine because the cooling pump takes power provided by the internal combustion engine and uses that power to pump a cooling fluid or coolant through the internal combustion engine. If the size of the pump could be reduced by using a portion of the waste heat produced by an engine to assist in pumping the cooling fluid, the parasitic load would be reduced, increasing the efficiency of the internal combustion engine.

SUMMARY

This disclosure provides an internal combustion engine comprising an engine body, and exhaust system connected to the engine body, a cooling fluid circuit, and a pumping system. The exhaust system is adapted to receive an exhaust gas from the engine body and includes a heat exchanger. The cooling fluid circuit is adapted to cool the engine body. The cooling fluid circuit contains a coolant and includes a radiator. The pumping system is connected to the cooling fluid circuit at a first location between the radiator and the engine body, upstream from the engine body, and at a second location between the engine body and the radiator, downstream of the engine body. The pumping system includes a fluid pump adapted to cause a portion of the coolant to flow through the heat exchanger. The pumping system also includes an ejector pump positioned at a second location to receive the coolant from the heat exchanger to cause a pumping action on the coolant in the cooling fluid circuit to cause the coolant in the cooling fluid circuit to circulate between the engine body and the radiator.

This disclosure also provides an internal combustion engine comprising an engine body, an exhaust system connected to the engine body, a cooling fluid circuit, and a pumping system. The exhaust system is adapted to receive an exhaust gas from the engine body. The exhaust system includes a heat exchanger. The cooling fluid circuit is adapted to cool the engine body. The cooling fluid circuit contains a coolant and includes a radiator. The pumping system is connected to the cooling fluid circuit at a first location between the radiator and the engine body, upstream from the engine body, and at a second location between the engine body and the radiator, downstream of the engine body. The pumping system includes a fluid pump positioned upstream from the heat exchanger and operable to move coolant through the heat exchanger. The pumping system also includes an ejector pump positioned at the second location and adapted to receive the coolant from the pumping system to cause the coolant in the cooling fluid system to circulate in the cooling fluid system between engine body and the radiator.

This disclosure also provides a method of pumping coolant in the internal combustion engine. The method comprises forming a cooling fluid circuit extending from a radiator to an engine body and containing a coolant. The method further comprises diverting a portion of the coolant from the cooling fluid circuit into a pumping circuit by the action of a fluid pump. The method also comprises transferring heat from an exhaust gas flowing from the engine body to the coolant flowing through the pumping system, causing the coolant to expand. The method also comprises positioning an ejector pump downstream from the heat exchanger and the engine body and connecting the expanding coolant and the cooling fluid circuit to the ejector pump so that the flow of expanding coolant through the ejector pump causes the coolant in the cooling fluid circuit to circulate through the cooling fluid circuit.

Advantages and features of the embodiments of this disclosure will become more apparent from the following detailed description of exemplary embodiments when viewed in conjunction with the accompanying drawings.

DETAILED DESCRIPTION

Figure 1:
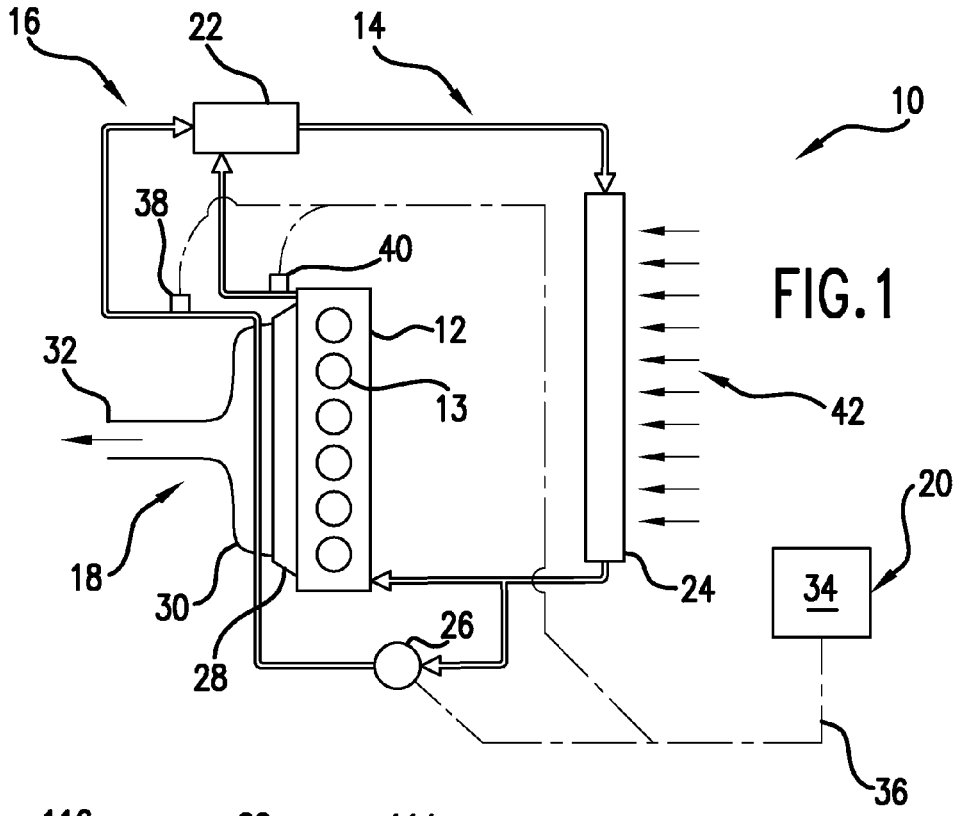
FIG. 1 is a schematic of a first exemplary embodiment of the present disclosure.

Referring now to FIG. 1, an internal combustion engine 10 incorporating a first exemplary embodiment of the present disclosure may include an engine body or block 12, a cooling fluid circuit 14 to direct cooling fluid or coolant through engine body 12, a pumping system 16 to pump cooling fluid through engine body 12, an exhaust system 18, and a control system 20.

Cooling fluid circuit 14 may include a radiator 24, which may be a heat exchanger or cooler. Pumping system 16 may include a conventional ejector pump 22 and a fluid pump 26. Exhaust system 18 may include an exhaust manifold 28, a heat exchanger/boiler 30, and a downstream flow path 32. Control system 20 may include a control module 34, a wire harness 36, a first temperature sensor 38 and a second temperature sensor 40.

Control module 34 may be an electronic control unit or electronic control module (ECM) that monitors the performance of engine 10 or may monitor other vehicle conditions. Control module 34 may be a single processor, a distributed processor, an electronic equivalent of a processor, or any combination of the aforementioned elements, as well as software, electronic storage, fixed lookup tables and the like. Control module 34 may connect to certain components of engine 10 by wire harness 36, though such connection may be by other means, including a wireless system. Control module 34 may include a digital or analog circuit.

Cooling fluid circuit 14 extends from radiator 24 to engine body 12, and back to radiator 24. Ejector pump 22 is positioned along cooling fluid circuit 14 downstream from engine body 12 and upstream from radiator 24. Radiator 24 may be passively cooled by air, ram air, or other cooling methods 42.

Pumping system 16 fluidly connects to cooling fluid circuit 14 at a location downstream from radiator 24 and upstream of engine body 12, and extends through heat exchanger 30 to connect with ejector pump 22 at a second location along cooling fluid circuit 14 downstream of engine body 12. Fluid pump 26 is positioned along pumping system 16 upstream from heat exchanger 30.

Exhaust system 18 extends from exhaust manifold 28 to downstream flow path 32. Heat exchanger 30 may be positioned between exhaust manifold 28 and downstream flow path 32. Heat exchanger 30 may be positioned adjacent to exhaust manifold 28, integrated into exhaust manifold 28, or positioned a spaced distance downstream from exhaust manifold 28. Downstream flow path 32 may include exhaust gas recirculation (not shown), aftertreatment components (not shown), turbocharger turbines (not shown), and other elements.

Cooling fluid or coolant may be stored throughout cooling fluid circuit 14, including radiator 24 and engine body 12. When engine 10 first starts, fluid pump 26 begins to circulate coolant through pumping system 16. Fluid pump 26 may have a relatively small pumping capacity. For example, fluid pump 26 may be capable of pumping or diverting only 3% to 10% of the total coolant flow into pumping system 16, with the remainder flowing through cooling fluid circuit 14 once the system reaches full flow.

As the pumped coolant flows from pumping system 16 into and through ejector pump 22, the action of the fluid pumped into ejector pump 22 and thus fundamental effect of the ejector pump, causes coolant to be drawn into cooling fluid circuit 14 downstream of engine body 12 and through ejector pump 22 causing the combined flow to exit ejector pump 22. As a result, coolant is pumped, or flows, through cooling fluid circuit 14. Ejector pump 22 may also be described as a Venturi ejector pump or a Venturi pump. The coolant flowing through cooling fluid circuit 14 circulates from radiator 24 through engine body 12, thereby cooling engine body 12. The coolant then flows through ejector pump 22 by the action of fluid flowing from pumping system 16 through ejector pump 22. The combined flow then returns to radiator 24.

As combustion occurs within engine body 12, heated exhaust gas from a plurality of engine cylinders 13 formed within engine body 12 flows into exhaust system 18. The temperature of the exhaust gas rises quickly. As the exhaust gas flows through heat exchanger 30, the exhaust gas raises the temperature of the coolant flowing through pumping system 16, causing the coolant flowing through pumping system 16 to expand. The expansion of the coolant increases the volume of flow through ejector pump 22 from pumping system 18, which increases the amount of coolant in cooling fluid circuit 14 flowing through ejector pump 22. Eventually, the temperature of the exhaust gas raises the temperature of the coolant to its phase change point, when at least some of the liquid changes from a liquid to a gas, forming a high-energy mixed phase fluid flow. The rapidly expanding coolant flows into ejector pump 22, which increases the volume of coolant pumped by ejector pump 22 through cooling fluid circuit 14, maintaining the temperature in engine body 12 within a desirable range. The coolant from pumping system 16 joins the coolant in cooling fluid circuit 14, returning any gaseous coolant to a liquid state since the volume of the gaseous coolant is relatively small in comparison to the volume of coolant flowing through cooling fluid circuit 14 and because of the temperature of the coolant flowing through cooling fluid circuit 14.

Control system 20 may assist in determining the amount of coolant that fluid pump 26 directs into pumping system 16. Control module 34 of control system 20 may receive a temperature signal from first temperature sensor 38 positioned along pumping system 16 downstream from heat exchanger 30. Control module 34 may also receive a temperature signal from second temperature sensor 40 positioned along cooling fluid circuit 14 downstream from engine body 12. Control system 20 may use the temperature signals to determine the amount of cooling required from cooling fluid circuit 14. Of course, in other embodiments, these temperature signals may be used in combination with other signals (not shown) received from engine 10. Control system 20 may then adjust the volume of fluid diverted into pumping system 16 by sending a control signal to fluid pump 26 to vary the speed of operation of pump 26 to thereby control the amount of coolant ejector pump 22 circulates within cooling fluid circuit 14. For example, when additional fluid circulation is desired in cooling fluid circuit 14 and the temperature within heat exchanger 30 is sufficient to vaporize the coolant flowing through heat exchanger 30, which may be indicated by temperature sensor 38, ECU or control module 34 sends a signal to fluid pump 26 to increase the flow rate of coolant into pumping system 16. The increased flow of coolant into pumping system 16 increases the amount of coolant vaporized within heat exchanger 30, increasing the volume of flow into ejector pump 22 from pumping system 16, which increases the flow rate of coolant in cooling fluid circuit 14. Conversely, when less fluid circulation is desired in cooling fluid circuit 14, which may be indicated by temperature sensor 40, ECU 34 sends a signal to fluid pump 26 to decrease the flow rate of coolant into pumping system 16, which decreases the flow of vaporized coolant through ejector pump 22, decreasing the flow of coolant in cooling circuit 14. Thus, fluid pump 26 is operable to pump to the minimum extent necessary to circulate fluid within cooling fluid circuit 14, decreasing the load that cooling fluid circuit 14 would normally place on engine 10, thus increasing the efficiency of engine 10. Fluid pump 26 may be any type of pump capable of variable speed operation or variable displacement operation that enables adjusting the rate of flow through pumping system 16.

Figure 2:
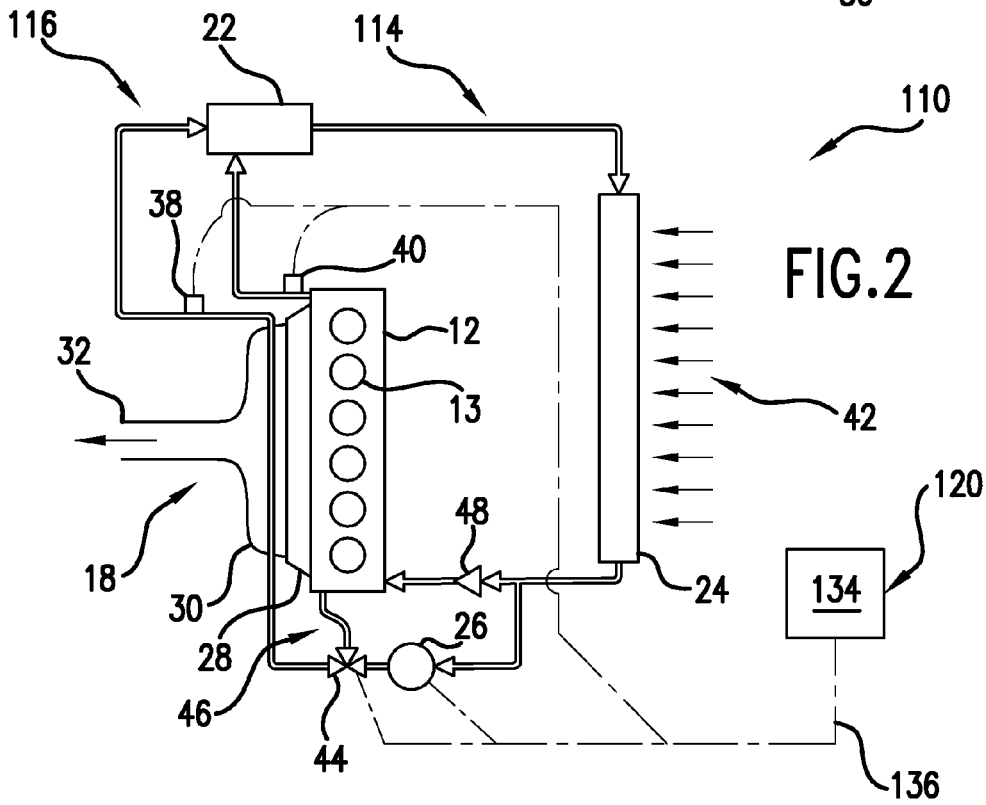
FIG. 2 is a schematic of a second exemplary embodiment of the present disclosure.

Referring now to FIG. 2, an internal combustion engine 110 incorporating a second exemplary embodiment of the present disclosure may include engine body or block 12, cooling fluid circuit 14 to direct cooling fluid or coolant through engine body 12, a pumping system 116 to pump cooling fluid through engine body 12, exhaust system 18, and a control system 120. Elements having the same number as the previous embodiment function as described in the previous embodiment and described again in this embodiment only for clarity.

Cooling fluid circuit 114 may include ejector pump 22, radiator 24, which may be a heat exchanger or cooler, and a check valve 48. Pumping system 116 may include fluid pump 26 and a bypass valve 44. Control system 120 may include a control module 134, a wire harness 136, first temperature sensor 38 and second temperature sensor 40.

Control module 134 may be an electronic control unit or electronic control module (ECM) that monitors the performance of engine 110 or may monitor other vehicle conditions. Control module 134 may be a single processor, a distributed processor, an electronic equivalent of a processor, or any combination of the aforementioned elements, as well as software, electronic storage, fixed lookup tables and the like. Control module 134 may connect to certain components of engine 110 by wire harness 136, though such connection may be by other means, including a wireless system. Control module 134 may be a digital or analog circuit.

Cooling fluid circuit 114 extends from radiator 24 to engine body 12, and back to radiator 24. Ejector pump 22 is positioned along cooling fluid circuit 114 downstream from engine body 12 and upstream from radiator 24. Radiator 24 may be passively cooled by air, ram air, or other cooling methods 42. Cooling fluid circuit 114 may also include check valve 48. Check valve 48 may be positioned between engine body 12 and radiator 24.

Pumping system 116 fluidly connects to cooling fluid circuit 14 at a location downstream from radiator 24 and upstream of check valve 48, and extends through heat exchanger 30 to connect with ejector pump 22 at a second location along cooling fluid circuit 14 downstream from engine body 12. Fluid pump 26 may be positioned along pump system 116 upstream from heat exchanger 30. Bypass valve 44 may be positioned along pump system 116 between fluid pump 26 and heat exchanger 30. A bypass flow path 46 may extend from bypass valve 44 to engine body 12.

Exhaust system 18 may be configured as described in the previous embodiment.

Coolant may be stored throughout cooling fluid circuit 114, including radiator 24 and engine body 12. When engine 110 first starts, control system 120 may operate fluid pump 26 at full speed and may operate bypass valve 44 to send fluid flow through bypass path 46 into engine body 12. The purpose of this fluid flow is to provide cooling of engine 110 during cold start and light duty operation when the temperature of the exhaust flowing through heat exchanger is insufficient to expand or vaporize the coolant flowing through pumping system 116 a sufficient amount to cause adequate coolant flow through cooling fluid circuit 114.

Bypass valve 44 may operate as a proportional valve movable to partial open/closed positions or may be modulated or cycled rapidly between positions, also called binary operation or modulation. After the cooling fluid enters engine body 12 via bypass path 46, the cooling fluid re-enters cooling fluid circuit 114, which extends through engine body 12. Check valve 48 or another device having a function similar to check valve 48 may prevent the flow of cooling fluid upstream from engine body 12 to radiator 24. Fluid pump 26 may have a pumping capacity sufficient to pump or divert up to approximately 50% of the total engine coolant flow into pumping system 116, with the remainder flowing through cooling fluid circuit 14 once the system reaches full flow.

As engine 110 operates, the temperature of exhaust gas flowing through heat exchanger 30 increases through the action of the combustion process associated with cylinders 13. The increasing temperature of the exhaust gas entering exhaust system 116 increases the ability of heat exchanger 30 to expand or vaporize the coolant flowing through pumping system 30, which may be detected by temperature sensor 38 or other temperature sensors associated with the temperature of the exhaust gas from engine 110. Once the temperature of heat exchanger 30 is sufficient to provide adequate flow through ejector pump 22 by way of the expanding coolant, which may be detected by temperature sensor 38, temperature sensor 40, or by other means, ECU 134 may send a control signal to bypass valve 44 to direct coolant through heat exchanger 30. The temperature of heat exchanger 30 then increases the temperature of the coolant to its phase change point, when at least some of the coolant vaporizes, forming a high-energy mixed phase fluid flow. The expanding coolant flows through ejector pump 22, which increases circulation of coolant through cooling fluid circuit 114 beyond the capability of pump 26 alone because of the heat energy transferred to the coolant in pumping system 116.

The rapidly expanding cooling fluid flows into ejector pump 22, which increases the volume of cooling fluid pumped by ejector pump 22 through cooling fluid circuit 114 beyond the capability of pump 26 alone because of the heat energy transferred to the coolant in pumping system 116, maintaining the temperature in engine body 12 within a desirable range for operation. The coolant from pumping system 16 joins the coolant in cooling fluid circuit 114, returning any gaseous coolant to a liquid state because of the volume and temperature of the coolant flowing through cooling fluid circuit 114. The combined flow returns to radiator 24.

Control system 120 may optimize the amount of cooling fluid that fluid pump 26 directs into pumping system 16 and into cooling circuit 114. Control module 134 of control system 120 may receive a temperature signal from first temperature sensor 38 positioned along pumping system 116 downstream from heat exchanger 30. Control module 134 may also receive a temperature signal from second temperature sensor 40 positioned along cooling fluid circuit 114 downstream from engine body 12. Control system 120 may use the temperature signals to determine the amount of cooling required from cooling fluid circuit 114. In other embodiments, these temperatures signals may be used in combination with other signals (not shown) received from engine 110. Control system may then send control signals to adjust the position of bypass valve 44 and the speed of fluid pump 26. Adjusting the position of bypass valve 44 and the speed of fluid pump 26 controls the volume of cooling fluid diverted into pumping system 116, which controls the amount of cooling fluid ejector pump 22 circulates within cooling fluid circuit 114, as described in the previous embodiment. Since ejector pump 22 provides the primary motive force for circulating cooling fluid within cooling fluid circuit 114, control system 120 may operate fluid pump 26 to the minimum extent necessary to operate ejector pump 22 to circulate fluid within cooling fluid circuit 114. Thus, the configuration of engine 110 is capable of decreasing the load that cooling fluid circuit 114 would normally place on engine 110, thus increasing the efficiency of engine 110.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. An internal combustion engine, comprising:

an engine body;

an exhaust system connected to the engine body and adapted to receive an exhaust gas from the engine body, the exhaust system including a heat exchanger;

a cooling fluid circuit adapted to cool the engine body, the cooling fluid circuit containing a coolant and including a radiator; and a pumping system connected to the cooling fluid circuit at a first location between the radiator and the engine body, upstream from the engine body, and at a second location along the cooling fluid circuit between the engine body and the radiator, upstream of the radiator and downstream of the engine body, the pumping system including a fluid pump positioned downstream of the radiator and upstream of the heat exchanger and wherein the fluid pump is adapted to cause a first portion of the coolant to flow through the heat exchanger, and wherein the fluid pump is configured to receive the first portion of the coolant from the radiator before it is moved through the heat exchanger, and an ejector pump positioned at the second location to receive the first portion of the coolant from the heat exchanger to cause a pumping action on a second portion of the coolant, in the cooling fluid circuit upstream of the radiator and downstream of the engine body, to cause at least the second portion of the coolant to circulate between the engine body and the radiator.

2. The internal combustion engine of claim 1, further including a temperature sensor positioned along the pumping system downstream from the heat exchanger and operable to transmit a temperature signal, and a control system adapted to receive the temperature signal and to transmit a control signal to the fluid pump to adjust the speed of the fluid pump based at least in part on the temperature signal.

3. The internal combustion engine of claim 1, further including a bypass valve located downstream from the fluid pump and operable to operable to adjust the amount of coolant from the fluid pump that flows into the heat exchanger and the engine body.

4. The internal combustion engine of claim 3, further including a temperature sensor positioned along the pumping system downstream from the heat exchanger and operable to transmit a temperature signal, and a control system adapted to receive the temperature signal and to transmit a control signal to the bypass valve to adjust the amount of coolant flowing to the engine body based at least in part on the temperature signal.

5. The internal combustion engine of claim 3, further including a temperature sensor positioned along the cooling fluid circuit downstream from the engine body and operable to transmit a temperature signal, and a control system adapted to receive the temperature signal and to transmit a control signal to the bypass valve to adjust the amount of coolant flowing to the engine body based at least in part on the temperature signal.

6. The internal combustion engine of claim 3, further including a first temperature sensor positioned along the pumping system downstream from the heat exchanger and operable to transmit a first temperature signal, a second temperature sensor positioned along the cooling fluid circuit downstream from the engine body and operable to transmit a second temperature signal, and a control system adapted to receive the first temperature signal and the second temperature signal, and to transmit a control signal to the bypass valve to adjust the amount of coolant flowing to the engine body based at least in part on the first temperature signal and the second temperature signal.

7. The internal combustion engine of claim 1, further including a temperature sensor positioned along the cooling fluid circuit downstream from the engine body and operable to transmit a temperature signal, and a control system adapted to receive the temperature signal and to transmit a control signal to the fluid pump to adjust the speed of the fluid pump based at least in part on the temperature signal.

8. The internal combustion engine of claim 1, wherein the fluid pump is adapted to pump at least three percent and no more than ten percent of the total coolant flow, with the remainder of the flow being provided by the action of the ejector pump.

9. The internal combustion engine of claim 1, wherein the fluid pump is adapted to pump up to fifty percent of the total coolant flow, with the remainder of the flow being provided by the action of the ejector pump.

10. The internal combustion engine of claim 1, wherein the heat exchanger is adjacent to the exhaust manifold.

11. The internal combustion engine of claim 1, further including a temperature sensor positioned along the pumping system downstream from the heat exchanger and operable to transmit a temperature signal, and a control system adapted to receive the temperature signal and to transmit a control signal to the fluid pump to adjust the speed of the fluid pump based at least on part on the temperature signal.

12. An internal combustion engine, comprising:

an engine body;

an exhaust system connected to the engine body and adapted to receive an exhaust gas from the engine body, the exhaust system including a heat exchanger;

a cooling fluid circuit adapted to cool the engine body, the cooling fluid circuit containing a coolant and including a radiator; and a pumping system connected to the cooling fluid circuit at a first location between the radiator and the engine body, upstream from the engine body, and at a second location along the cooling fluid circuit between the engine body and the radiator, upstream of the radiator and downstream of the engine body, the pumping system including a fluid pump positioned upstream from the heat exchanger and downstream from the radiator and operable to receive a first portion of the coolant from the radiator and to move the first portion of the coolant through the heat exchanger, wherein the fluid pump is configured to receive the first portion of the coolant before it is moved through the heat exchanger; and an ejector pump positioned at the second location and adapted to receive the first portion of the coolant from the pumping system to cause at least a second portion of the coolant to circulate in the cooling fluid system between the engine body and the radiator.

13. A method of pumping coolant in an internal combustion engine, the method comprising:

forming a cooling fluid circuit extending from a radiator to an engine body and containing a coolant;

diverting a first portion of the coolant exiting from the radiator into a pumping circuit by the action of a fluid pump;

moving the first portion of the coolant through a heat exchanger by the action of the fluid pump, wherein the first portion of the coolant exiting the radiator is received by the fluid pump before it is moved through the heat exchanger;

transferring heat, using a heat exchanger, from an exhaust gas flowing from the engine body to the first portion of the coolant flowing through the pumping system, causing the first portion of the coolant to expand; and positioning an ejector pump at a location along the cooling fluid circuit between the engine body and the radiator, upstream of the radiator and downstream of the engine body, and along the pumping circuit downstream from the heat exchanger so that the flow of expanding coolant through the ejector pump causes at least a second portion of the coolant to circulate through the cooling fluid circuit.

14. The method of claim 13, further including a temperature sensor positioned along the cooling fluid circuit downstream from the engine body and adapted to transmit a temperature signal, and a control system adapted to receive the temperature signal and operable to send a control signal to the fluid pump.

15. The method of claim 13, further including a temperature sensor positioned along the cooling fluid circuit downstream from the heat exchanger and adapted to transmit a temperature signal, and a control system adapted to receive the temperature signal and operable to send a control signal to the fluid pump.

16. The method of claim 13, further including a bypass valve located downstream from the fluid pump and operable to adjust the amount of coolant from the pump that flows into the heat exchanger and the engine body.

17. The method of claim 16, further including a temperature sensor positioned along the pumping system downstream from the heat exchanger and operable to transmit a temperature signal, and a control system adapted to receive the temperature signal and to transmit a control signal to the bypass valve to adjust the amount of coolant flowing to the engine body based at least in part on the temperature signal.

18. The method of claim 16, further including a temperature sensor positioned along the cooling fluid circuit downstream from the engine body and operable to transmit a temperature signal, and a control system adapted to receive the temperature signal and to transmit a control signal to the bypass valve to adjust the amount of coolant flowing to the engine body based at least in part on the temperature signal.

19. The method of claim 16, further including a first temperature sensor positioned along the pumping system downstream from the heat exchanger and operable to transmit a first temperature signal, a second temperature sensor positioned along the cooling fluid circuit downstream from the engine body and operable to transmit a second temperature signal, and a control system adapted to receive the first temperature signal and the second temperature signal, and to transmit a control signal to the bypass valve to adjust the amount of coolant flowing to the engine body based at least in part on the first temperature signal and the second temperature signal.

20. The method of claim 13, wherein transferring heat, using a heat exchanger, from an exhaust gas flowing from the engine body to the first portion of the coolant comprises raising a temperature of the first portion of the coolant to a phase change point of the coolant, thereby forming a high-energy mixed phase fluid flow.

* * * * *